United States Patent [19]

Dschen

[11] 4,242,858

[45] Jan. 6, 1981

[54] OPEN-END SPINNING DEVICE

[75] Inventor: Yuan-Heng Dschen, Baden, Switzerland

[73] Assignee: BBC Brown, Boveri & Company, Limited, Baden, Switzerland

[21] Appl. No.: 939,955

[22] Filed: Sep. 6, 1978

[30] Foreign Application Priority Data

Sep. 15, 1977 [CH] Switzerland ..... 11286/77

[51] Int. Cl.[3] ..... D01H 1/135

[52] U.S. Cl. ..... 57/58.89; 57/100

[58] Field of Search ..... 57/58.89–58.95, 57/100

[56] References Cited

U.S. PATENT DOCUMENTS

| | | | |
|---|---|---|---|
| 3,367,099 | 2/1968 | Kubovy et al. | 57/58.89 |
| 3,769,785 | 11/1973 | Schiltknecht | 57/58.89 |
| 3,837,153 | 9/1974 | Didek et al. | 57/58.89 X |
| 3,924,398 | 12/1975 | Esser et al. | 57/58.89 |
| 3,972,171 | 8/1976 | Handschuch et al. | 57/58.89 |
| 3,972,172 | 8/1976 | Waleckx | 57/58.89 |
| 3,981,132 | 9/1976 | Miyazaki et al. | 57/58.89 |
| 3,999,365 | 12/1976 | Suzuki | 57/58.89 X |
| 4,070,813 | 1/1978 | Quandt et al. | 57/58.89 |
| 4,112,663 | 9/1978 | Chrtek et al. | 57/58.89 |
| 4,117,359 | 9/1978 | Wehde | 57/58.89 X |

*Primary Examiner*—John Petrakes

*Attorney, Agent, or Firm*—Burns, Doane, Swecker & Mathis

[57] ABSTRACT

An open-end spinning device is disclosed including a spinning rotor which is provided in a spinning-compartment housing having reduced pressure. The spinning-compartment housing has contours which correspond to the surface of the spinning rotor, with the distance between the spinning rotor and the spinning-compartment housing being relatively short. Upon rotation of the spinning rotor, the air clinging to the surface of the spinning rotor is set in motion as a result of boundary-layer friction. Because of the resulting centrifugal force and because of the short distance between the surface of the spinning rotor and the spinning-compartment housing, a stream of air is produced in the direction of the back of the spinning rotor.

9 Claims, 1 Drawing Figure

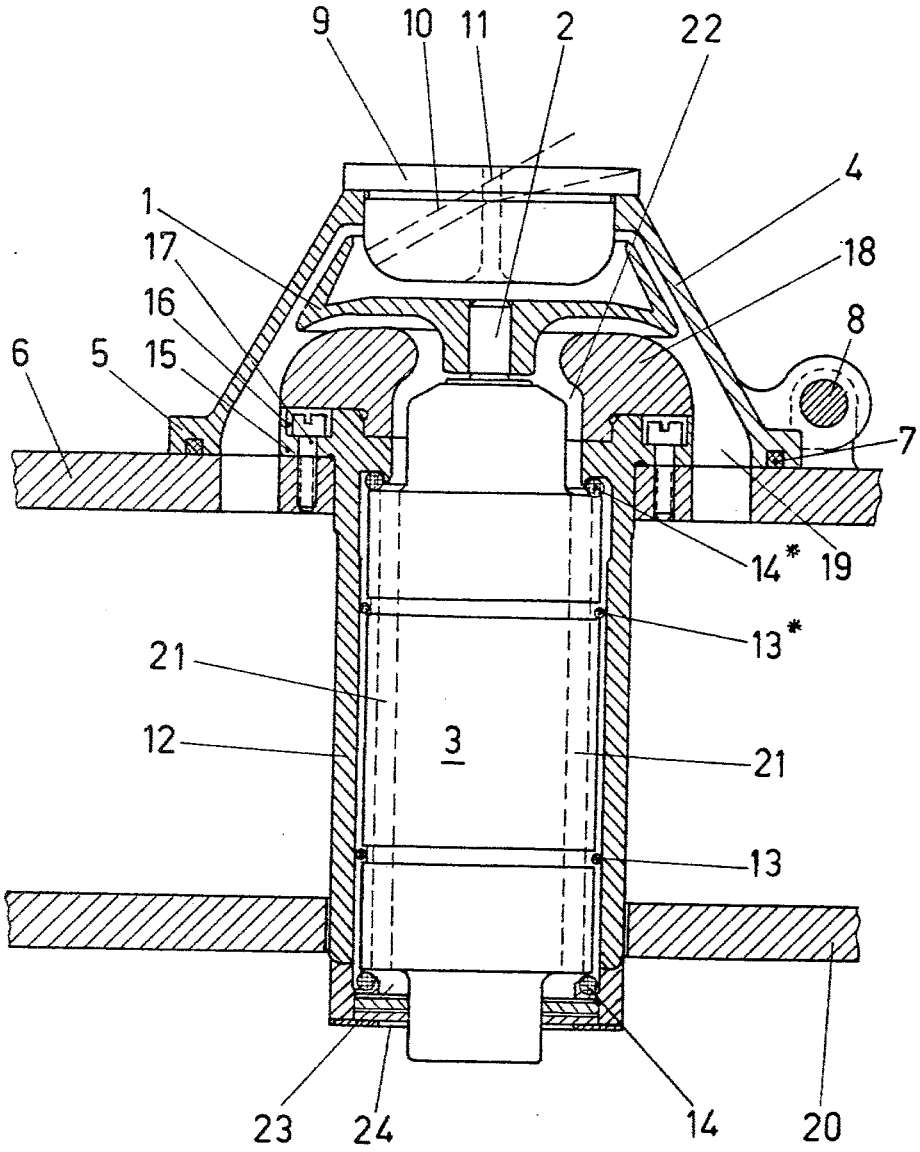
9
10
11
2
22
4
1
17
18
16
8
6
5
15
7
14*
19
13*
21
12
3
21
13
23
24
14
20

OPEN-END SPINNING DEVICE

BACKGROUND AND SUMMARY OF THE PRESENT INVENTION

The present invention relates generally to spinning devices and more particularly relates to open-end spinning devices.

A known spinning rotor such as is disclosed in German Patent Application No. 2328715 which has been laid open for public inspection on 1975-1-9, of Wilhelm Stahleiker GmbH, Reichenbach, Germany, rotates in a housing under a reduced pressure. A rear wall of the housing is provided with a bore through which a shaft of the rotor passes with the shaft being mounted outside the rear wall. The rotating parts are constructed in the form of air-conducting or air-conveying devices which act from the inside of the housing outwardly. A plurality of bores are provided in the bottom of the spinning compartment which lead to the back of the spinning rotor and terminate in the region of a sealing gap between a flange of the spinning rotor and the rear wall of the housing. The purpose of this arrangement is to produce a reduced pressure in the spinning compartment and at the same time to cool a bearing of the device.

The effectiveness of this device depends on the nature, number and arrangement of the bores in the bottom of the spinning compartment. For adequate cooling, a large number of bores must be provided which should be arranged at as large an angle as possible with respect to the axis of rotation. The provision of the bores involves considerable expense because the spinning rotors must necessarily be precisely manufactured since even small deviations in mass lead to great unbalance when the peripheral speeds of the rotor exceed 40,000 revolutions per minute. Extremely high speeds of rotation cannot be achieved with rotors which are out-of-balance because the detrimental effect of the unbalance increases quadratically with increasing speed. In addition, a relatively large spinning-compartment housing has an unfavorable effect both on the energy consumption and on the development of noise because of the large amounts of air which are made turbulent and are heated by the high speed spinning rotor. Additional energy then has to be expended to draw off this heat.

Accordingly, an object of the present invention is to provide an open-end spinning device having both a reduced energy consumption and a lowered noise level and wherein no expensive machining of the spinning rotor is necessary for the independent production of reduced pressure.

In the open-end spinning device of the present invention, a spinning rotor is provided in a spinning-compartment housing with internal contours of the spinning-compartment housing corresponding to the surface of the spinning rotor. The spinning rotor is separated from the spinning-compartment housing by only a short distance in comparison with the length of the surface of the spinning rotor.

Important advantages of the present invention include a reduced energy consumption because of less air turbulence. Furthermore, less heat is generated in the spinning housing, and the noise level is reduced. Finally, the reduced pressure in the spinning compartment which is a requirement of the spinning process is produced by air friction occuring at the generated surface of the spinning rotor.

The spacing between the spinning rotor and the rotor housing preferably amounts to about 0.5 mm to 3 mm. The spacing is great enough to prevent contact between the spinning rotor and the spinning-compartment housing, but at the same time it is small enough to produce a sufficient stream of air and, accordingly, a sufficiently reduced pressure in the spinning compartment of the spinning rotor.

It is an advantage to provide at the back of the spinning rotor a toroidal intermediate member which is disposed at a slight distance from the spinning rotor. The generated surface of the intermediate member together with the internal contours of the spinning-compartment housing forms a diffusor-like air outlet. This arrangement ensures a uniform stream of air which is essentially free of air turbulence and prevents the stream of air from breaking away. With an appropriate configuration of the side of the toroidal intermediate member which is adjacent to the spinning rotor, a loss-free conversion of the speed of the air into pressure of the stream of air between the spinning-compartment housing and the motor housing will take place. The spinning rotor, the spinning-compartment housing and the intermediate member preferably have corresponding diameters so that they can be readily exchanged for like parts with different masses. As a result, a spinning machine can be equipped with spinning rotors of other sizes without losing the effect of the device according to the present invention.

In order to increase the air-conveying capacity and hence the reduced pressure in the spinning compartment, it is advantageous to provide grooves in the generated surface of the spinning rotor. Furthermore, it is preferable to have the spinning-compartment housing appropriately hingedly connected to the front wall. In this way, rapid access to the spinning rotor is readily available without difficulty.

BRIEF DESCRIPTION OF THE DRAWINGS

The present invention is explained in more detail below with reference to a specific embodiment which is illustrated in the single accompanying drawing wherein like reference numerals refer to like members. The drawing is a cross sectional view of an open-end spinning unit with a housing according to the present invention.

DETAILED DESCRIPTION OF THE PREFERRED EMBODIMENT

With reference to the single FIGURE, a spinning rotor is secured to a shaft 2 of an electric motor 3. The spinning rotor 1 is frustoconical in construction and is received in a spinning-compartment housing 4 having internal contours corresponding to the generated surface of the spinning rotor 1. The spinning-compartment housing 4 is extended rearwardly in a streamlined fashion and is provided with a flange 5 which rests on a front wall 6.

At the side adjacent to the wall 6, the flange 5 is provided with a sealing ring 7. The spinning-compartment housing 4 is hingedly secured to the front wall 6 by means of a hinge 8. In the specific embodiment of the FIGURE, a spacing of about 2 mm is provided between the spinning rotor 1 and the spinning-compartment housing 4. At the front of the spinning-compartment housing 4, a large aperture is fitted with a cover 9 in a sealing manner, with the cover containing a fiber feed passage 10 and a yarn offtake nozzle 11.

An electric motor 3 is provided in a motor housing 12 with the motor supported by a plurality of rubber rings 13—13* and 14—14*. At an end of the motor housing adjacent to the spinning rotor, the motor housing 12 includes a flange 15 having a plurality of bores 16 disposed therein. The flange 15 is mounted on the front wall 6 by a plurality of screws 17.

Secured to the flange 15 for easy replacement is a toroidal intermediate member 18 which extends to within about 2 mm of the back of the spinning rotor 1. The side of the toroidal intermediate member 18 which is adjacent to the spinning rotor 1 conforms to shape of the back of the spinning rotor and extends essentially parallel thereto. The outer generated surface of the intermediate member 18 together with the internal contours of the rear portion of the spinning-compartment housing 4 accordingly forms a diffusor-like air outlet 19 which leads into a space between the front wall 6 and a rear wall 20.

A plurality of air ducts 21 are provided in the electric motor 3 and extend over the entire length of the electric motor 3. At the spinning-rotor side, the air ducts 21 lead into a cavity 22 which is formed inside the intermediate member 18, and at the other side lead into a cavity 23 which is formed by the motor housing 12 and in which an air filter 24 is provided.

The mode of operation of the device according to the present invention is explained as follows with reference to the specific embodiment illustrated in the drawing.

During rotation of the spinning rotor 1, the air clinging to the generated surface of the spinning rotor 1 is set in motion by boundary-layer friction, and as a result both of centrifugal force and of the relatively short distance of the generated surface of the spinning rotor from the spinning-compartment housing 4, a stream of air is produced in the direction of the back of the spinning rotor. This stream of air causes air to be drawn out of the spinning compartment which is closed by the cover 9 and so a substantially reduced pressure (as is necessary in the spinning compartment) results. As soon as the reduced pressure in the spinning compartment has reached a certain value, a return flow develops along the inner wall of the spinning-compartment housing 4. The extent of return flow depends on the pressure drop between the spinning compartment and the air outlet 19 and thus limits the reduced pressure produced in the spinning compartment.

The diffusor-like air outlet 19 provides a gradual slowing down of the stream of air without any so-called "breaking away" of the stream. In this way air turbulence is prevented. The diffusor-like air outlet 19 communicates with the space between the front wall 6 and the rear wall 20 with the result that any fibers which may be contained in the stream of air collect in this space.

Through the device according to the invention, the boundary-layer friction at the rotating spinning turbine is used to produce a reduced pressure (necessary for the spinning operation), in the spinning compartment or to reinforce a source of reduced pressure which may already be present. Additional sources of reduced pressure of a special machining of the spinning rotor are only necessary in special cases such as when a relatively great reduced pressure is needed. The additional energy required as a result of the boundary-layer friction is not, as in the previously known solutions, converted into heat through air turbulence , which then has to be additionally drawn off, but is used to produce the reduced pressure (necessary for the spinning process). It has also been found that the energy consumption of a spinning rotor in a housing which surrounds the spinning rotor closely is considerably less than in spinning rotors which are provided in housings of larger dimensions. As a result of the regular flow conditions, the noise level is reduced by about 20 dB.

The present invention as disclosed with reference to the specific embodiment is intended to be considered in all respects as illustrative and not as restrictive, the scope of the invention being indicated by the appended claims rather than by the foregoing description. All changes which come within the meaning and range of equivalency of the claims are therefore intended to be embraced therein.

What is claimed is:

1. An open-end spinning device, comprising:

a spinning rotor having a frustoconical shape;

a toroidal intermediate member arranged closely beneath the spinning rotor;

a spinning compartment housing, the spinning rotor being closely received within the spinning compartment housing with the spinning compartment housing, the spinning rotor and the toriodal intermediate member together defining a first flow path extending between the frustoconical spinning rotor and the spinning compartment housing in a direction of increasing radius of the spinning rotor and then between a radial outer surface of the toroidal intermediate member and the spinning compartment housing, and with a pressure differential being provided across the first flow path during rotation of the rotor; and means for rotating the spinning rotor.

2. The device of claim 1 wherein the pressure drop is the result of boundary-layer friction of air between the spinning rotor and the spinning compartment housing.

3. The device of claim 1 wherein the spinning compartment housing is substantially closed at one end by a front cover member.

4. The device of claim 1 wherein an outer surface of the spinning rotor is located between about 0.5 mm to 3 mm away from an inner surface of the spinning compartment housing.

5. The device of claim 1, wherein the toroidal intermediate member cooperates with the spinning compartment housing to form an air outlet for the spinning rotor with the air flow through the first flow path being substantially turbulence-free.

6. The device of claim 5 wherein the air outlet diffuses an air stream produced by rotation of the spinning rotor.

7. The device of claim 5 wherein:

the means for rotating the spinning rotor includes an electric motor; and, further comprising:

air passageway means for supplying ambient air to a space between the spinning rotor and the toroidal intermediate member, the air passageway means including at least one passageway extending axially of the electric motor and in communication with the first flow path.

8. The device of claim 1 further comprising a front wall member, the spinning compartment being hingedly received by the front wall member.

9. An open-end spinning device, comprising:

a spinning rotor which is frustoconical in shape;

a spinning compartment housing, including a front cover, the spinning rotor being closely received within the spinning compartment housing so that a stream of air, generated by boundary layer friction on the surface of the spinning rotor during rotation of the rotor, is produced;

a toroidal intermediate member arranged closely beneath the spinning rotor with a radially outward surface of the toroidal intermediate member and an inner surface of the spinning compartment housing together forming an air discharge opening which permits a substantially non-turbulent exhaust of said air; and electric motor means for rotating the spinning rotor, said motor means having at least one axial air passageway communicating with a discharge passageway defined between the spinning rotor and the toroidal intermediate member.

* * * * *